US009156269B2

(12) United States Patent
Kuroda et al.

(10) Patent No.: US 9,156,269 B2
(45) Date of Patent: Oct. 13, 2015

(54) LIQUID EJECTION APPARATUS

(71) Applicant: DAINIPPON SCREEN MFG. CO., LTD., Kyoto-shi, Kyoto (JP)

(72) Inventors: Takashi Kuroda, Kyoto (JP); Tamio Fukui, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 14/206,791

(22) Filed: Mar. 12, 2014

(65) Prior Publication Data

US 2014/0267495 A1 Sep. 18, 2014

(30) Foreign Application Priority Data

Mar. 13, 2013 (JP) ..... P2013-049887

(51) Int. Cl.
*B41J 2/165* (2006.01)

(52) U.S. Cl.
CPC ..... *B41J 2/16538* (2013.01); *B41J 2/16552* (2013.01); *B41J 2/16588* (2013.01)

(58) Field of Classification Search
CPC ..... B41J 2/16538
USPC ..... 347/22
See application file for complete search history.

(56) References Cited

U.S. PATENT DOCUMENTS

2009/0046122 A1* 2/2009 Inoue ..... 347/33
2012/0056935 A1 3/2012 Nitta

FOREIGN PATENT DOCUMENTS

JP 2012-71582 4/2012

* cited by examiner

*Primary Examiner* — Manish S Shah
*Assistant Examiner* — Jeffrey C Morgan
(74) *Attorney, Agent, or Firm* — McDermott Will & Emery LLP

(57) ABSTRACT

An inkjet printer includes a cleaning unit to be brought into contact with a head lower surface of an ejection head, and a unit movement mechanism for moving the cleaning unit. The cleaning unit includes a base part, a cleaning liquid ejecting part protruding above the base part, and a pair of positioning parts. The positioning parts are brought into contact with a block lower surface of a head fixation block on opposite sides of the cleaning liquid ejecting part to keep an under-head gap for holding the cleaning liquid between the cleaning liquid ejecting part and the head lower surface. Since the positioning parts are spaced from the cleaning liquid ejecting part, it is possible to prevent the cleaning liquid that has spread from the under-head gap to the surrounding area from adhering to the block lower surface via the positioning parts.

20 Claims, 9 Drawing Sheets

LIQUID EJECTION APPARATUS

TECHNICAL FIELD

The present invention relates to a liquid ejection apparatus.

BACKGROUND ART

Conventionally, inkjet printers have been used to print an image onto printing paper by ejecting fine droplets of ink from a plurality of outlets of an ejection head toward the printing paper while moving the printing paper relative to the ejection head. In such inkjet printers, an ejection surface is cleaned by wiping off ink adhering to a head lower surface of the ejection head having the outlets with a wiper formed of rubber or a synthetic resin.

Japanese Patent Application Laid-Open No. 2012-71582 (Document 1) discloses a technique in which a slight gap (e.g., an approximately 0.1-mm gap) is provided between a cleaning member and a nozzle surface of an inkjet head when the cleaning member is moved along the nozzle surface, and ink is selectively discharged from nozzles facing the cleaning member and is held in the gap. In the inkjet recording apparatus of Document 1, the meniscus of the ink held in the gap serves to remove ink mist or dirt on the nozzle surface. The cleaning member is configured such that, in a portion of the cleaning member that faces the nozzle surface, portions on opposite sides of a nozzle array form two raised portions that extend along the nozzle array and that are in direct contact with the nozzle surface, and the aforementioned ink to be held between the cleaning member and the nozzle surface is filled into the space between the two raised portions.

Incidentally, bringing part of the cleaning member into direct contact with the nozzle surface as described above makes it possible to easily position the cleaning member relative to the nozzle surface. In this case, it is also possible to easily maintain the position of the cleaning member relative to the nozzle surface when the cleaning member is moving.

On the other hand, as in Document 1, if ink is held in the space between the two raised portions serving as positioning parts for the cleaning member, the ink may enter between the nozzle surface and the raised portions and adhere to portions of the nozzle surface that face the raised portions.

SUMMARY OF INVENTION

The present invention is intended for a liquid ejection apparatus, and it is an object of the present invention to prevent a liquid for use in cleaning a lower surface of an ejecting part from adhering to the lower surface of the ejecting part via positioning parts.

A liquid ejection apparatus according to the present invention includes an ejecting part for ejecting a liquid toward a base material, the ejecting part and the base material moving relative to each other in a predetermined movement direction, and a cleaning mechanism for cleaning a lower surface of the ejecting part. The ejecting part includes an ejection head having a head lower surface in which a plurality of outlets for ejecting the liquid are arranged in an arrangement direction that intersects the movement direction, and a guiding part for fixing a position of the ejection head relative to the guiding part and having a guide lower surface that is spaced from the head lower surface on each side in the movement direction. The cleaning mechanism includes a cleaning unit to be brought into contact with the head lower surface, and a cleaning unit movement mechanism for moving the cleaning unit relative to the ejection head in a cleaning direction from one side to the other side in the arrangement direction to allow the cleaning unit to clean the head lower surface. The cleaning unit includes a base part, a liquid holding part protruding above a central portion of the base part, the central portion facing the head lower surface, and for holding a liquid in a gap between the head lower surface and the liquid holding part, a wiping part fixed to the base part further to a rear side of the cleaning unit in the cleaning direction than the liquid holding part and for wiping the head lower surface while in contact with the head lower surface, and a pair of positioning parts that are located on opposite sides of the liquid holding part in the movement direction, spaced from the liquid holding part, and protrude above the base part, and are for maintaining the gap while in contact with the guide lower surface.

With the liquid ejection apparatus, it is possible to prevent a liquid from adhering to the lower surface of the ejecting part via the positioning parts.

In a preferred embodiment of the present invention, the liquid holding part serves as a cleaning liquid ejecting part for supplying a cleaning liquid as the liquid into and holding the cleaning liquid in the gap between the head lower surface and the liquid holding part.

In another preferred embodiment of the present invention, the pair of positioning parts are each in the shape of a wall extending in the arrangement direction, and a space between the liquid holding part and each of the pair of positioning parts is in the shape of a groove extending in the arrangement direction.

In another preferred embodiment of the present invention, the liquid holding part has a smaller width in the movement direction than the head lower surface.

In another preferred embodiment of the present invention, the wiping part is fixed to the base part at a distance from rear ends of the pair of positioning parts in the cleaning direction.

In another preferred embodiment of the present invention, the cleaning mechanism further includes an elevating mechanism for moving the cleaning unit up and down.

In another preferred embodiment of the present invention, the ejecting part ejects fine droplets of ink.

These and other objects, features, aspects and advantages of the present invention will become more apparent from the following detailed description of the present invention when taken in conjunction with the accompanying drawings.

DESCRIPTION OF EMBODIMENTS

Figure 1:
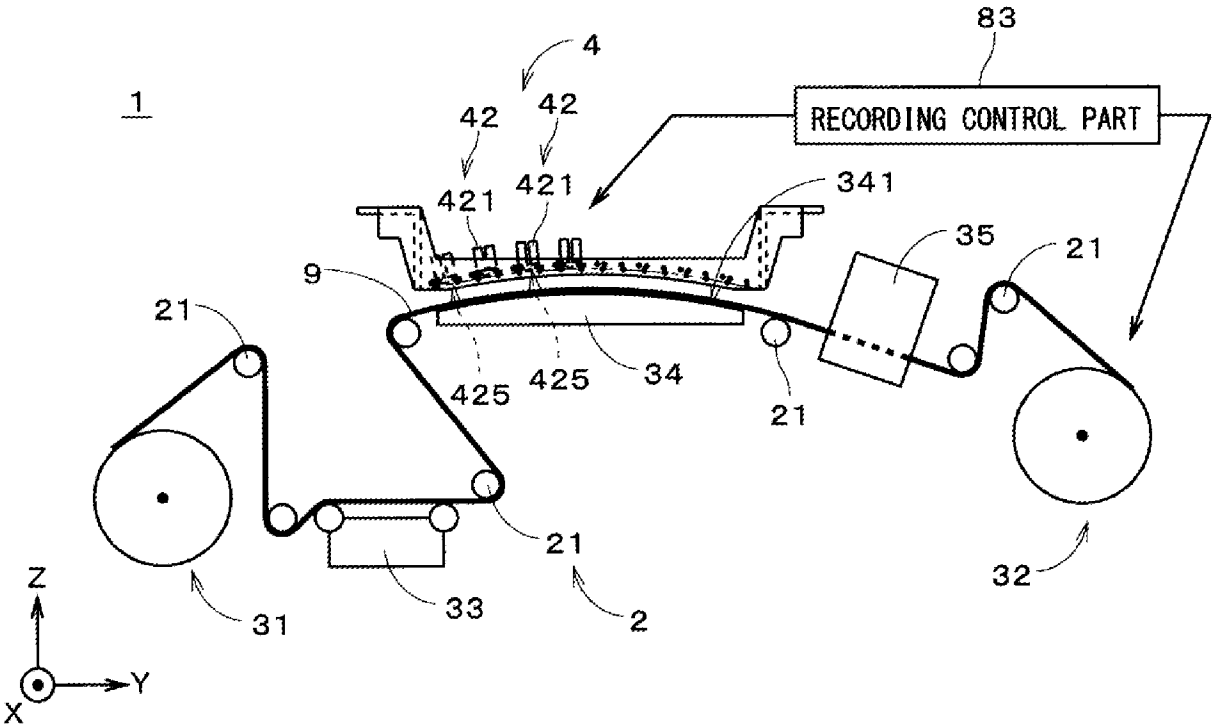
FIG. 1 illustrates a configuration of an inkjet printer according to an embodiment of the present invention.

FIG. 1 illustrates a configuration of an inkjet printer 1 that is a liquid ejection apparatus according to an embodiment of the present invention. The inkjet printer 1 is an apparatus for forming an image on a base material 9 in continuous sheet form, such as continuous form paper, by ejecting fine droplets of ink toward the base material 9. In FIG. 1, it is assumed that the two horizontal directions perpendicular to each other are X and Y directions and the vertical direction perpendicular to the X and Y directions is a Z direction. The X and Y directions in FIG. 1 do not necessarily have to be in the horizontal direction, and the Z direction also does not necessarily have to be in the vertical direction. In other words, the upper and lower sides in FIG. 1 do not necessarily have to correspond to the upper and lower sides in the direction of gravity. In FIG. 1, a maintenance part, which will be described later, is not shown.

The inkjet printer 1 includes a conveying mechanism 2, a head unit 4, and a recording control part 83. The conveying mechanism 2 is configured to move the base material 9, which is in sheet form. The head unit 4 is an ejecting part for ejecting fine droplets of UV curing ink toward the base material 9 that is being moved by the conveying mechanism 2. The recording control part 83 is configured to control the conveying mechanism 2 and the head unit 4 when an image is recorded onto the base material 9.

The conveying mechanism 2 shown in FIG. 1 includes a plurality of rollers 21 that are each long in the X direction in FIG. 1. In the vicinity of the roller 21 that is disposed furthest to the −Y side is provided a supply part 31 for holding a roll of base material 9 (supply roll). In the vicinity of the roller 21 that is disposed furthest to the +Y side is provided a take-up part 32 for holding the roll of base material 9 (take-up roll). In the inkjet printer 1, some of the rollers 21 of the conveying mechanism 2 rotate at a constant rotational speed about an axis parallel to the X direction, so that the base material 9 moves at a constant speed along a predetermined travel path from the supply part 31 to the take-up part 32.

On the travel path of the base material 9, a base material guiding part 34 is provided at a position opposing the head unit 4 in the up-down direction. The base material guiding part 34 has a curved upper surface 341 (hereinafter, referred to as a "guideway 341"). The guideway 341 is part of a cylindrical surface that centers on a virtual axis parallel to the X direction. The virtual axis is located immediately under the head unit 4 (on the −Z side). Under the head unit 4, the base material 9 moves along the smooth guideway 341. In this way, the travel path of the base material 9 curves upward toward the head unit 4 at the position opposing the head unit 4, and accordingly the base material 9 is stretched along the guideway 341. At the position opposing the head unit 4, the base material 9 moves relative to the head unit 4 along the guideway 341 in a predetermined movement direction that is roughly in the +Y direction.

On the travel path of the base material 9, a skew correction part 33 for correcting skewing of the base material 9 is provided between the supply part 31 and the base material guiding part 34, and a curing part 35 for emitting light (in the present embodiment, ultraviolet rays) for curing ink is provided between the base material guiding part 34 and the take-up part 32. Note that the inkjet printer 1 may be provided with other constituent elements such as a pre-processing part for performing predetermined pre-processing on the base material 9.

Figure 2:
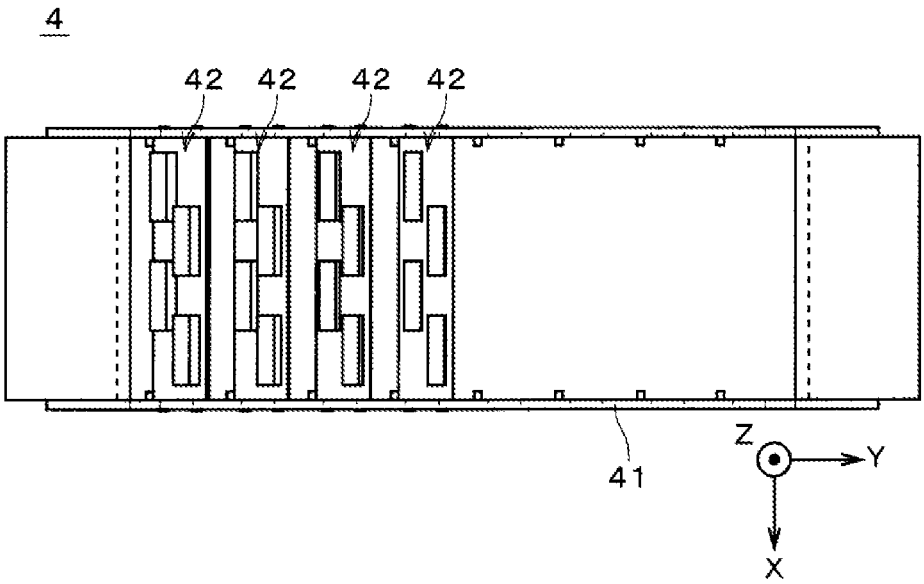
FIG. 2 is a plan view of a head unit.
Figure 3:
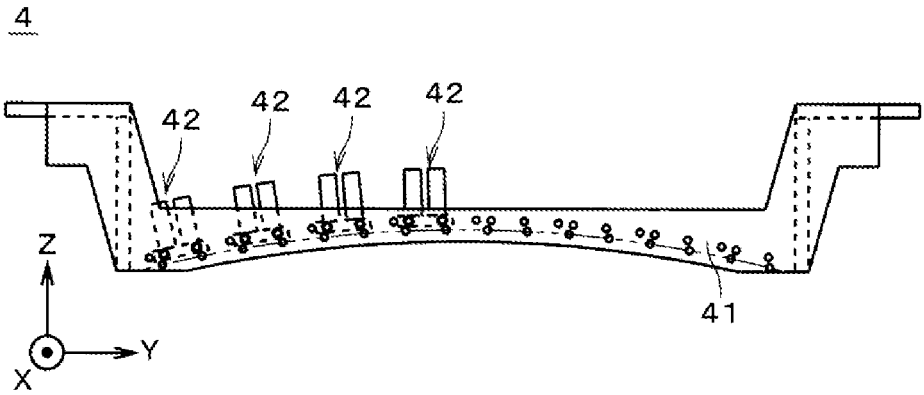
FIG. 3 is a front view of the head unit.

FIG. 2 is a plan view of the head unit 4, and FIG. 3 is a front view of the head unit 4. The head unit 4 includes a plurality of head assemblies 42 that are a plurality of head parts being long in the X direction and a base 41 for supporting the plurality of head assemblies 42. The head assemblies 42 are arranged in substantially the Y direction (to be precise, in the aforementioned movement direction). Each of the head assemblies 42 ejects fine droplets of ink toward the base material 9.

In the present embodiment, four head assemblies 42 are mounted on the base 41. In the head unit 4, the head assemblies 42 for respectively ejecting inks of black (K), cyan (C), magenta (M), and yellow (Y) are arranged from the −Y side in the stated order. Mounted on the base 41 may be other head assemblies 42 for ejecting inks of white or specific colors, for example. Alternatively, the head assemblies 42 may eject other types of ink such as invisible ink.

The base 41 may also have mounted thereon an emitting assembly for emitting light toward the base material 9, in addition to the head assemblies 42. In this case, the inks ejected on the base material 9 will be pre-cured by irradiation with the light (ultraviolet rays) emitted from the emitting assembly onto the base material 9. A maximum of eight assemblies including the head assemblies 42 and the emitting assembly are mountable on the base 41. The number, type, and mounting positions of assemblies mounted on the base 41 may be appropriately changed. Also, the maximum number of mountable assemblies on the base 41 is not limited to eight.

Figure 4:
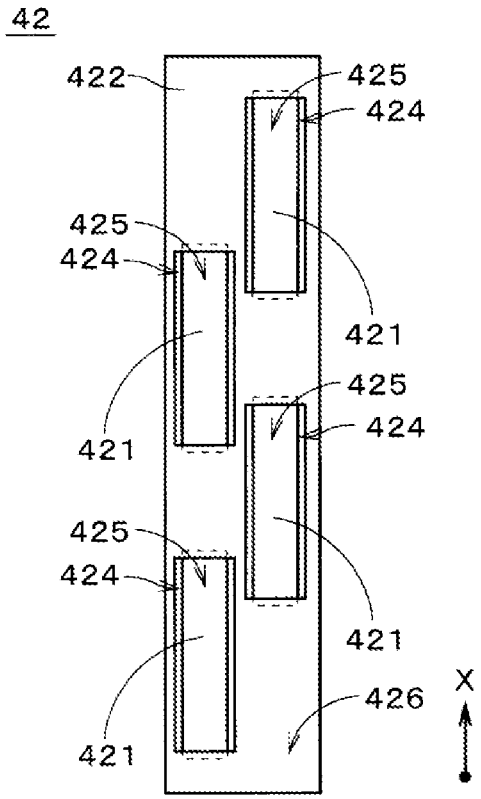
FIG. 4 is a bottom view of a head assembly.
Figure 5:
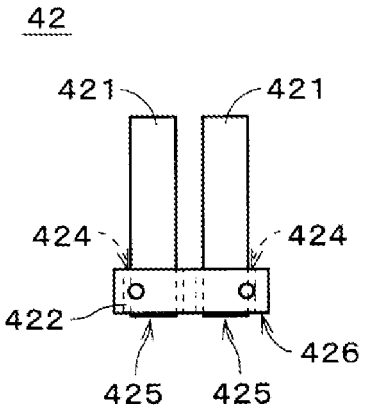
FIG. 5 is a front view of the head assembly.

FIG. 4 is a bottom view of one head assembly 42, and FIG. 5 is a front view of the head assembly 42. The following description focuses on the head assembly 42 for ejecting an ink of one color, but the other head assemblies 42 also have the same configuration. The head assembly 42 is fixed to the base 41 in an orientation in which the head assembly 42 is inclined by a slight rotation angle with respect to an axis parallel to the longitudinal direction of the head assembly 42 (i.e., the X direction). Thus, strictly speaking, the lateral direction in FIG. 4 does not correspond to that in FIG. 2, and the longitudinal and lateral directions in FIG. 5 do not correspond to those in FIG. 3. The lateral directions in FIGS. 4 and 5 substantially correspond to the movement direction of the base material 9 that moves under the head assemblies 42.

The head assembly 42 includes a head fixation block 422 having a substantially rectangular parallelepiped shape that is long in the X direction, and a plurality of ejection heads 421 that are each long in the X direction. In the present embodiment, four ejection heads 421 are mounted on the head fixation block 422. The head fixation block 422 is a head holding part for holding a plurality of ejection heads 421. By mounting the ejection heads 421 on the head fixation block 422, the relative positions of the ejection heads 421 are fixed, and the relative positions of the head fixation block 422 and the ejection heads 421 are also fixed.

The head fixation block 422 is formed of, for example, metal such as stainless steel. The head fixation block 422 has a plurality of through holes 424 arranged in a staggered configuration in the longitudinal direction. The ejection heads 421 are fixed to the head fixation block 422 in such a way that their lower ends (i.e., their ends on the −Z side) are respectively inserted in the through holes 424. Accordingly, the ejection heads 421 are arranged in a staggered configuration on the head fixation block 422. The longitudinal (X-direction) opposite ends of each of the ejection heads 421 are secured by screws or the like to the upper surface of the head fixation block 422.

The lower end of each of the ejection heads 421 protrudes slightly below a block lower surface 426 that is the lower end surface of the head fixation block 422. In other words, a head lower surface 425 that is the lower end surface of each of the ejection heads 421 is located slightly below the block lower surface 426. The head lower surface 425 is substantially parallel to the block lower surface 426, and the distance in a direction perpendicular to the head lower surface 425 between the head lower surface 425 and the block lower surface 426 is approximately 0.3 mm, for example.

The ejection heads 421 have a smaller width in the movement direction (i.e., the width in the right-left direction in FIGS. 4 and 5) than the through holes 424 of the head fixation block 422, and there is a gap in the movement direction between each side surface of each ejection head 421 and each inner side surface of each through hole 424. In other words, the block lower surface 426 is spaced from the head lower surface 425 of each ejection head 421 on each side in the movement direction.

Each of the ejection heads 421 has a plurality of outlets for ejecting ink arranged in the head lower surface 425 along its length, i.e., in the X direction. In the head assembly 42, a larger number of outlets arranged at a substantially constant pitch along its length, i.e., in the X direction, over the entire range from the vicinity of one end of the head fixation block 422 to the vicinity of the other end thereof. In the following description, the X direction is referred to as an "arrangement direction." The arrangement direction is substantially perpendicular to the aforementioned movement direction. Note that the arrangement direction does not necessarily have to be perpendicular to the movement direction as long as it intersects with the movement direction.

In the head unit 4 shown in FIG. 1, the head lower surfaces 425 of the ejection heads 421 in each of the head assemblies 42 are substantially parallel to the main surface of the base material 9 on the guideway 341. In other words, the ejection heads 421 are in upright positions relative to the base material 9. The outlets of the ejection heads 421 eject fine droplets of ink toward the main surface of the base material 9 in a direction substantially perpendicular to that main surface. In the case of recording an image onto the base material 9, a head elevating mechanism (not shown) lowers the head unit 4 toward the guideway 341 so as to bring the head lower surfaces 425 of the ejection heads 421 close to the main surface of the base material 9.

In the image forming processing of the inkjet printer 1, continuous portions of the base material 9 are sequentially drawn out from the supply part 31, and each of the portions (hereinafter, referred to as a "target portion") passes through the skew correction part 33 and reaches the base material guiding part 34. In the base material guiding part 34, the target portion moves in the movement direction while remaining in contact with the guideway 341, and the head unit 4 opposing the base material guiding part 34 records an image onto the target portion. Specifically, the four head assemblies 42 for respectively ejecting inks of K, C, M, and Y record color images of K, C, M, and Y onto the target portion. Thereafter, the target portion then moves to the curing part 35, in which the inks are cured, and is then taken up by the take-up part 32. This completes the image formation on the target portion.

In each of the head assemblies 42, the outlets are arranged in the X direction perpendicular to the movement direction across the entire width of an image recording region of the base material 9. In the inkjet printer 1, the recording of an image onto the base material 9 is completed in one pass of the base material 9 under the head unit 4 by the recording control part 83 controlling the conveying mechanism 2 and the head unit 4. In other words, an image is recorded onto the base material 9 by the base material 9 moving only once in the movement direction relative to the head unit 4. In this way, the inkjet printer 1 implements so-called single pass printing and allows an image to be formed in a short time.

Figure 6:
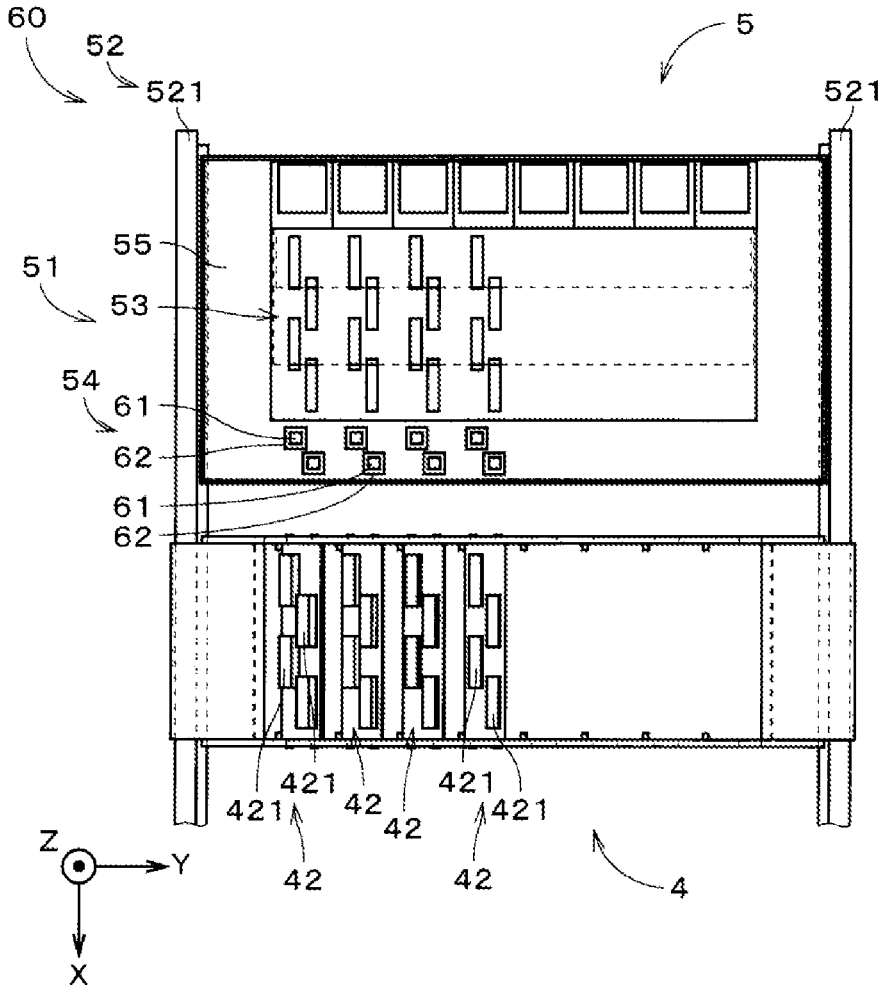
FIG. 6 is a plan view of a head unit and a maintenance part.
Figure 7:
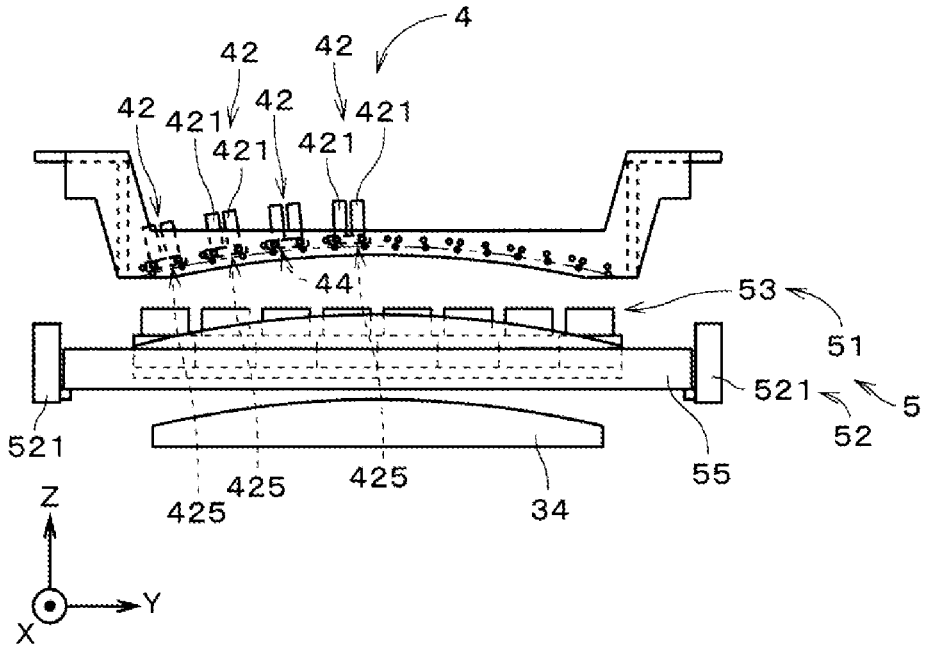
FIG. 7 is a front view of the head unit and the maintenance part.

FIG. 6 is a plan view of the head unit 4 and a maintenance part 5, and FIG. 7 is a front view of the head unit 4 and the maintenance part 5. FIG. 7 also shows the base material guiding part 34. FIGS. 6 and 7 shows a state in which the maintenance part 5 is positioned on the −X side of the head unit 4, and the head unit 4 is elevated by the head elevating mechanism (not shown) and disposed a great distance above the base material guiding part 34. The maintenance part 5 is located above the base material guiding part 34 (i.e., on the +Z side) and below the head unit 4.

The maintenance part 5 includes a maintenance unit 51 and a unit movement mechanism 52. The unit movement mechanism 52 moves the maintenance unit 51 in the X direction along guides 521 that extend in the X direction (i.e., the arrangement direction of the outlets of the head assemblies 42) below the head unit 4. During maintenance of the head unit 4, the maintenance unit 51 is moved from the position shown in FIG. 6 to the +X side and disposed under the head unit 4 (i.e., at a position between the head unit 4 and the base material guiding part 34). The maintenance of the head unit 4 involves operations for resolving clogging or the like of the outlets, such as purging in which pressure is applied to the flow path of ink so as to push the ink out of the outlets, spitting in which ink droplets are ejected periodically during standby before printing, and cleaning an ejection surface 44 that is the lower surface of the head unit 4.

The maintenance unit 51 includes a cap part 53, a cleaning part 54, and a unit base 55. In FIG. 7, the cleaning part 54 is not shown. The unit base 55 has a substantially rectangular parallelepiped shape having an open upper surface. The cap part 53 and the cleaning part 54 are disposed inside the unit base 55. The cap part 53 is configured to receive the liquid ejected from the head unit 4 (i.e., the ink ejected from the head assemblies 42) during maintenance such as the aforementioned purging or spitting. The cleaning part 54 is configured to clean the ejection surface 44 of the head unit 4.

The cleaning part 54 includes a plurality of cleaning units 61 arranged in the Y direction, and a plurality of elevating mechanisms 62 that are respectively disposed under the plurality of cleaning units 61. The elevating mechanisms 62 respectively and independently move the cleaning units 61 up and down. Each of the cleaning units 61 corresponds to two ejection heads 421 arranged in the X direction of the head unit 4 and is disposed at the same position in the Y direction as these two ejection heads 421. During the maintenance of the head unit 4, the maintenance unit 51 is disposed under the head unit 4 as described above, and accordingly the cleaning part 54 is positioned on the +X side of the head unit 4. By the unit movement mechanism 52 moving the maintenance unit 51 to the −X side, the cleaning part 54 passes under the head unit 4.

When passing under the head unit 4, each of the cleaning units 61 comes into contact with the head lower surfaces 425 of the corresponding two ejection heads 421 in order from the +X side and sequentially cleans the two head lower surfaces 425. In the following description, the direction directed from the +X side to the −X side is referred to as a "cleaning direction" of the cleaning unit 61. Also, the aforementioned movement direction of the base material 9 is referred to as a "base material movement direction."

In the inkjet printer 1, the unit movement mechanism 52 is a cleaning unit movement mechanism for moving each of the cleaning units 61 relative to the corresponding two ejection heads 421 in the cleaning direction from the +X side to the −X side (i.e., from one side to the other side in the arrangement direction) so that the head lower surfaces 425 of these two ejection heads 421 are cleaned. The cleaning part 54 and the unit movement mechanism 52 serve as a cleaning mechanism 60 for cleaning the ejection surface 44 of the head unit 4.

Figure 8:
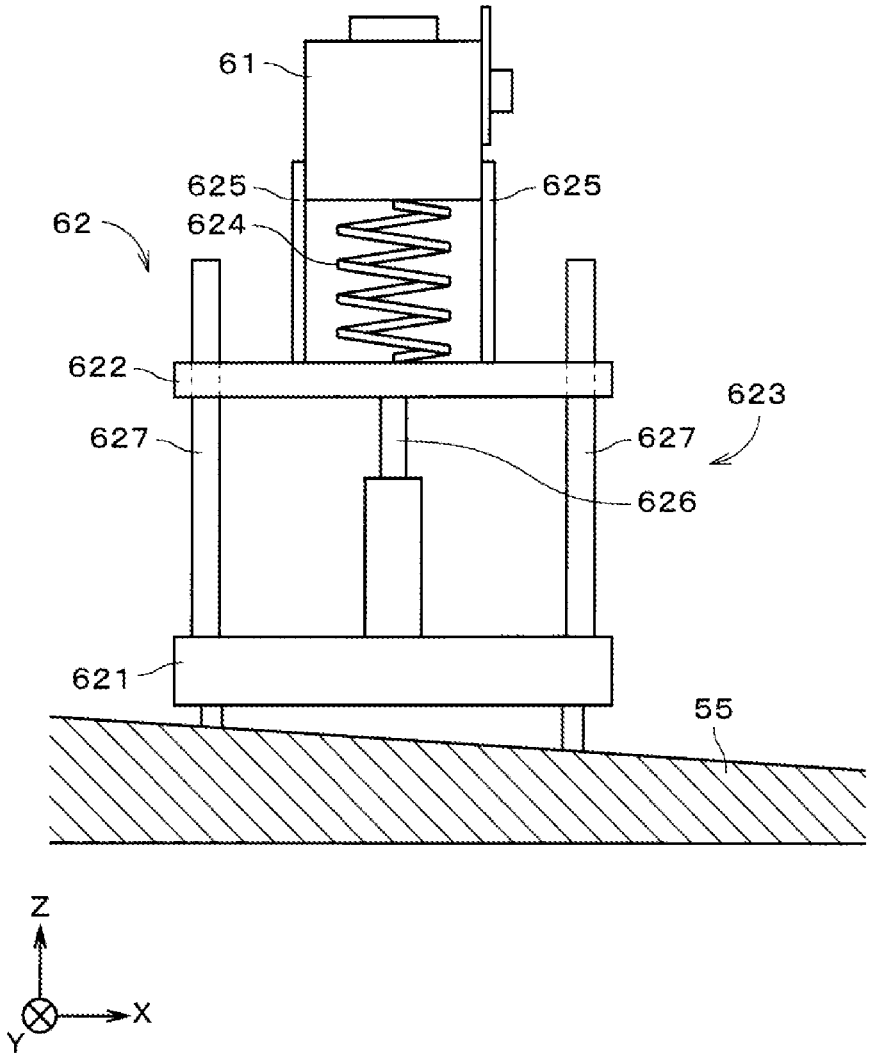
FIG. 8 is an enlarged side view of a cleaning unit and an elevating mechanism.
Figure 9:
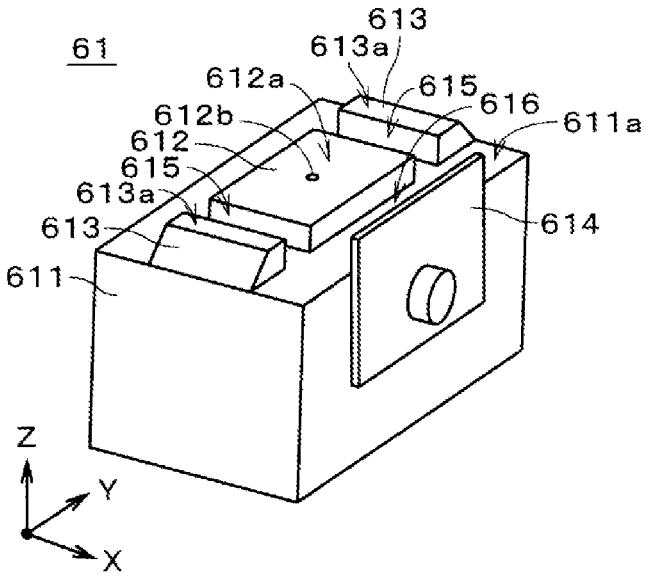
FIG. 9 is a perspective view of the cleaning unit.

FIG. 8 is an enlarged side view of a pair of the cleaning unit 61 and the elevating mechanism 62. FIG. 8 is a diagram of the cleaning unit 61 and the elevating mechanism 62 viewed from the +Y side. In FIG. 8, part of the unit base 55 is also shown in cross section. The structures of the other cleaning units 61 and elevating mechanisms 62 are the same as those of the cleaning unit 61 and the elevating mechanism 62 shown in FIG. 8. FIG. 9 is a perspective view of one of the cleaning units 61 viewed obliquely from above. As shown in FIG. 8, the elevating mechanism 62 includes an elevating base 621, an elevating block 622, an elevating part 623, an elastic part 624, and unit guiding parts 625.

The elevating base 621 is a substantially rectangular plate-like member that is fixed to the inner bottom surface of the unit base 55. The elevating block 622 is a substantially rectangular plate-like member that is disposed above the elevating base 621 (i.e., on the +Z side) and connected to the elevating base 621 by the elevating part 623. The elevating part 623 includes a cylinder 626 that is fixed to the elevating base 621 while facing upward and a plurality of guides 627 that extend upward from the elevating base 621. By driving the cylinder 626, the elevating block 622 moves up and down along the guides 627. When the elevating block 622 moves up and down, the elastic part 624, the unit guiding parts 625, and the cleaning unit 61 also move up and down together with the elevating block 622. Note that the elevating part 623 may be configured as a mechanism of various types such as a cam mechanism.

The elastic part 624 includes two spiral springs arranged in the Y direction. Each of the spiral springs extend in the up-down direction. The lower ends of the spiral springs are fixed to the elevating block 622, and the upper ends thereof are fixed to the lower surface of the cleaning unit 61. Note that the elastic part 624 may be configured as an elastic member of various types (e.g., plate springs) other than spiral springs.

The unit guiding parts 625 are provided on the +X and −X sides of the cleaning unit 61. The unit guiding parts 625 are two plate-like members that extend substantially perpendicular to the X direction. The two unit guiding parts 625 sandwich the lower end portion of the cleaning unit 61 from each side in the X direction. The cleaning unit 61 is in contact with the unit guiding parts 625, but is not fixed thereto. The unit guiding parts 625 prevent the cleaning unit 61 from moving in the X direction. By elastic deformation of the elastic part 624, the cleaning unit 61 is moved in the Z direction along the unit guiding parts 625 and inclined to either the +Y or −Y side.

As will be described later, when the cleaning unit 61 moves upward together with the elevating block 622 and the like and is brought into contact with the head unit 4, the elastic part 624 is flexed and the cleaning unit 61 is inclined or lowered such that the upper surface of the cleaning unit 61 follows the ejection surface 44 of the head unit 4 (i.e., becomes substantially parallel to the portion of the ejection surface 44 that faces the cleaning unit 61). This prevents the cleaning unit 61 from being strongly pressed against the ejection surface 44 of the head unit 4.

Figure 10:
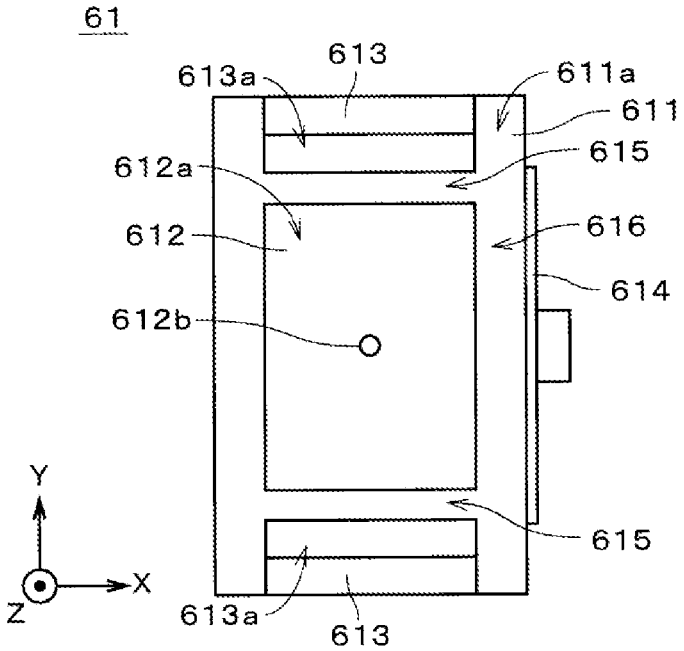
FIG. 10 is a plan view of the cleaning unit.

FIG. 10 is a plan view of the cleaning unit 61. As shown in FIGS. 9 and 10, the cleaning unit 61 includes a base part 611, a cleaning liquid ejecting part 612, a pair of positioning parts 613, and a wiping part 614. The base part 611 has a substantially rectangular parallelepiped shape. An upper surface 611*a* of the base part 611 is a flat surface substantially parallel to the horizontal plane. The base part 611 is formed of a resin, for example.

The cleaning liquid ejecting part 612 protrudes above a central portion of the upper surface 611*a* of the base part 611 in the Y direction and a central portion of the upper surface 611*a* of the base part 611 in the X direction. The cleaning liquid ejecting part 612 has a substantially rectangular parallelepiped shape that has a small thickness in the Z direction. The cleaning liquid ejecting part 612 can also be regarded as being substantially tabular in shape. The cleaning liquid ejecting part 612 is connected to piping (not shown) through which a cleaning liquid (e.g., a solvent of the ink ejected from the head unit 4) is supplied to the cleaning liquid ejecting part 612. The cleaning liquid ejecting part 612 has an outlet 612*b* in its upper surface 612*a* and ejects the cleaning liquid from the outlet 612*b*. The upper surface 612*a* of the cleaning liquid ejecting part 612 is substantially rectangular, having a pair of short sides substantially parallel to the X direction and a pair of long sides substantially parallel to the Y direction.

The two positioning parts 613 are located on opposite sides of the cleaning liquid ejecting part 612 in the aforementioned base material movement direction and protrudes above the upper surface 611*a* of the base part 611. The positioning parts 613 are spaced from the cleaning liquid ejecting part 612 on the +Y and −Y sides of the cleaning liquid ejecting part 612. The pair of positioning parts 613 are in the shape of walls that extend substantially parallel to each other in approximately the X direction (i.e., the aforementioned arrangement direction) along the short sides of the upper surface 612*a* of the cleaning liquid ejecting part 612. Each of the positioning parts 613 is, for example, in the shape of a prism extending in the X direction. The distance in the Z direction between the upper surface 611*a* of the base part 611 and the upper surfaces 613*a* of the positioning parts 613 is greater than that between the upper surface 611*a* of the base part 611 and the upper surface 612*a* of the cleaning liquid ejecting part 612. In other words, the upper surfaces 613*a* of the positioning parts 613 are located above the upper surface 612*a* of the cleaning liquid ejecting part 612.

A space between the cleaning liquid ejecting part 612 and each of the positioning parts 613 is in the shape of a groove extending in the X direction. Specifically, the +Y side surface of the cleaning liquid ejecting part 612, the −Y side surface of the positioning part 613 on the +Y-side, and a portion of the upper surface 611*a* of the base part 611 that is located between the cleaning liquid ejecting part 612 and the positioning part 613 on the +Y-side form a groove-like space 615 that extends in the X direction. Also, the −Y side surface of the cleaning liquid ejecting part 612, the +Y side surface of the −Y-side positioning part 613, and a portion of the upper surface 611*a* of the base part 611 that is located between the cleaning liquid ejecting part 612 and the −Y-side positioning part 613 form another groove-like space 615 that extends in the X direction. Hereinafter, the two spaces 615 are each referred to as a "first flow path 615."

The wiping part 614 is disposed further to the +X side, which is the rear side in the aforementioned cleaning direction, than the cleaning liquid ejecting part 612 and the pair of positioning parts 613. The wiping part 614 is a substantially flat-plate member formed of an elastic member that is elastically deformable by a relatively small force. The wiping part 614 may be a rubber plate, for example. The lower portion of the wiping part 614 is fixed to the +X side surface of the base part 611. The wiping part 614 is mounted on the base part 611, substantially perpendicular to the X direction. Note that the wiping part 614 may be mounted on the base part 611 in such an orientation that the wiping part 614 is gradually inclined to the −X side from the lower end to the upper end. The upper portion of the wiping part 614 is located above the upper surface 611*a* of the base part 611. In other words, the upper portion of the wiping part 614 protrudes above the upper surface 611*a* of the base part 611 from the +X-side edge. The upper portion of the wiping part 614 extends along the long side of the upper surface 612*a* of the cleaning liquid ejecting part 612 in the Y direction. The upper edge of the wiping part 614 is located above the upper surface 612*a* of the cleaning liquid ejecting part 612 and the upper surfaces 613*a* of the pair of positioning parts 613.

The wiping part 614 is fixed to the base part 611 while being spaced from the +X-side edge portion of the cleaning liquid ejecting part 612 and the +X-side end portions of the two positioning parts 613. A space between the upper portion of the wiping part 614 and the cleaning liquid ejecting part 612 is in the shape of a groove that extends in the base material movement direction. Specifically, the +X side surface of the cleaning liquid ejecting part 612, the −X side surface of the upper portion of the wiping part 614, and a portion of the upper surface 611*a* of the base part 611 that is located between the cleaning liquid ejecting part 612 and the wiping part 614 form a groove-like space 616 extending in the Y direction. Hereinafter, the space 616 is referred to as a "second flow path 616."

The bottom surface of the second flow path 616 extends to the +Y-side and +X-side edges of the base part 611 on the +Y side of the second flow path 616, and extends to the −Y-side and +X-side edges of the base part 611 on the −Y side of the second flow path 616. The bottom surfaces of the first flow paths 615 extend, on the +X side of the first flow paths 615, to the +X side of the base part 611 and to the +Y-side or −Y-side edge of the base part 611. Also, the bottom surfaces of the first flow paths 615 extend, on the −X side of the first flow paths 615, to the −X-side edge of the base part 611 and to the +Y-side or −Y-side edge of the base part 611.

Figure 11:
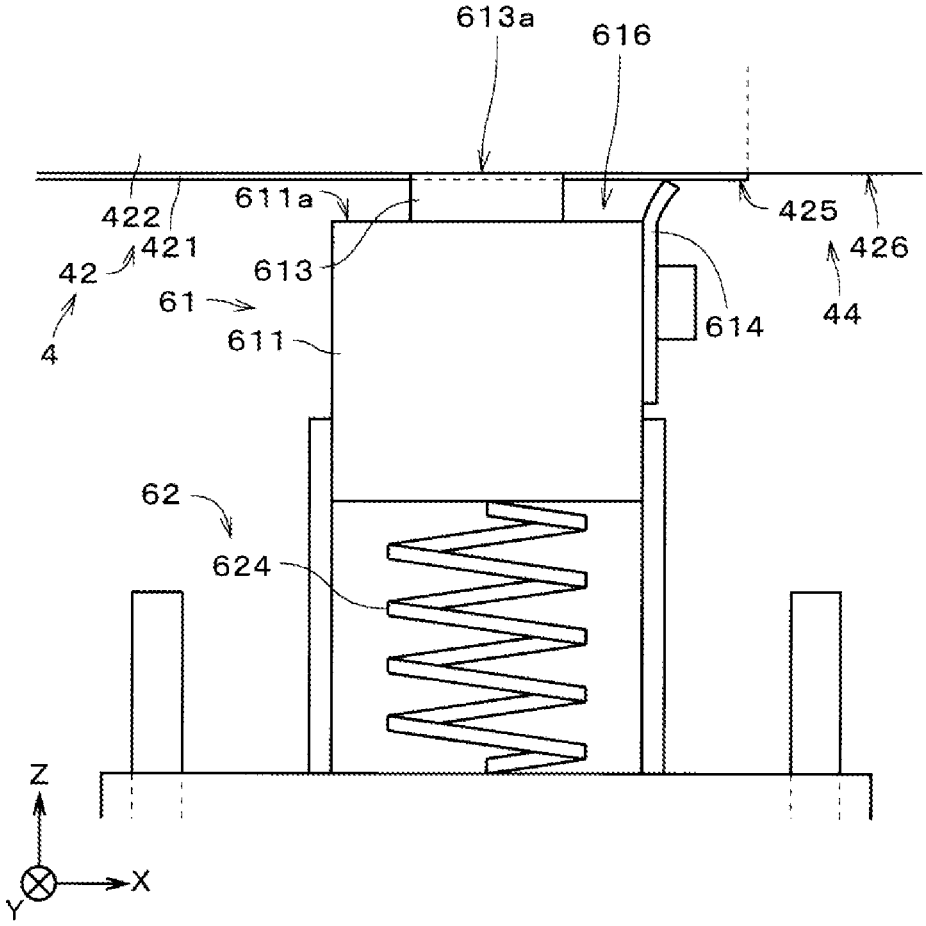
FIG. 11 is a partial enlarged side view of a cleaning unit and a head assembly.
Figure 12:
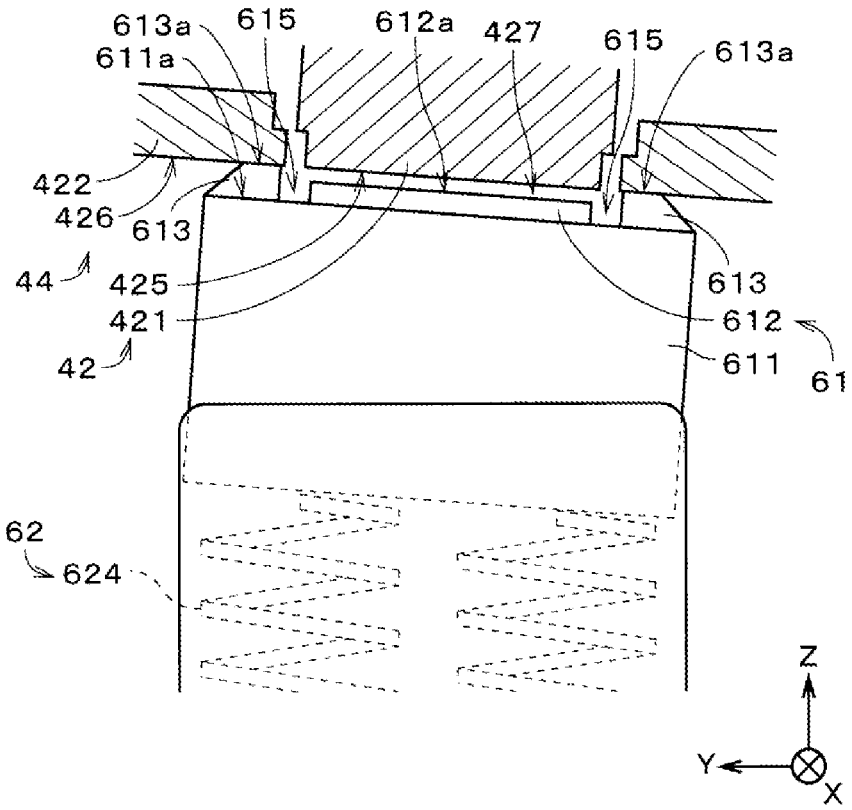
FIG. 12 is a partial enlarged rear view of the cleaning unit and the head assembly.

FIG. 11 is a partial enlarged side view of one cleaning unit 61 and one head assembly 42 during the maintenance of the head unit 4. FIG. 11 is a diagram of the cleaning unit 61 and the head assembly 42 viewed from the +Y side. FIG. 12 is a partial enlarged rear view of one cleaning unit 61 and one head assembly 42 during maintenance. The positional relationship between the other cleaning units 61 and the other head assemblies 42 during maintenance is the same as that shown in FIGS. 11 and 12.

During the maintenance of the head unit 4, the cleaning part 54 moves from the +X side of the head unit 4 in the −X direction as described above. When the cleaning unit 61 is positioned under the +X side edge portion of the ejection head 421 on the +X-side, which is one of the two ejection heads 421 arranged in the X direction, at a position facing the ejection head 421 on +X-side in the up-down direction, the cleaning unit 61 is moved upward by the elevating mechanism 62. Accordingly, part of the cleaning unit 61 is brought into contact with the head assembly 42 as shown in FIGS. 11 and 12. In FIG. 12, the head assembly 42 is illustrated in cross section.

Specifically, the upper surfaces 613*a* of the pair of positioning parts 613 of the cleaning unit 61 are brought into contact with the block lower surface 426 of the head fixation block 422. At this time, the elastic part 624 of the elevating mechanism 62 flexes and the cleaning unit 61 inclines to the −Y side so that, even if the block lower surface 426 is inclined with respect to the horizontal plane as shown in FIG. 12, both of the upper surfaces 613*a* of the pair of positioning parts 613 can be easily brought into contact with the block lower surface 426. Also, as shown in FIG. 11, the upper end of the wiping part 614 is brought into contact with the head lower surface 425 of the ejection head 421. The upper portion of the wiping part 614 is pushed downward by the head lower surface 425 and slightly deformed to the +X side. For easy understanding of the drawing, the wiping part 614 is not shown in FIG. 12.

The central portion of the upper surface 611*a* of the base part 611 faces the head lower surface 425 in the up-down direction, and the cleaning liquid ejecting part 612 protrudes above that central portion toward the head lower surface 425. The cleaning liquid ejecting part 612 is not in contact with the head lower surface 425, and there is a gap (hereinafter, referred to as an "under-head gap 427") between the upper surface 612*a* of the cleaning liquid ejecting part 612 and the head lower surface 425. The under-head gap 427 is maintained by the two positioning parts 613, which are located on opposite sides of the cleaning liquid ejecting part 612 in the base material movement direction, remaining in contact with the block lower surface 426. In FIG. 12, the base material movement direction is a direction along the head lower surface 425. Since the upper surface 612*a* of the cleaning liquid ejecting part 612 and the head lower surface 425 are substantially parallel to each other, the height of the under-head gap 427 is substantially constant over the entire area of the under-head gap 427.

When the cleaning unit 61 is brought into contact with the head assembly 42, a small amount of cleaning liquid is ejected from the cleaning liquid ejecting part 612 and supplied into the under-head gap 427. After a predetermined amount of cleaning liquid has been supplied, the ejection of the cleaning liquid is stopped. The cleaning liquid is filled in the under-head gap 427 and held by the cleaning liquid ejecting part 612 and the ejection head 421. That is, the cleaning liquid ejecting part 612 serves as a liquid holding part for holding a liquid in the under-head gap 427. Then, the cleaning unit 61 is moved to the −X side, which is forward in the aforementioned cleaning direction, and accordingly the head lower surface 425 is cleaned by the cleaning liquid held in the under-head gap 427. The head lower surface 425 is also wiped with the wiping part 614 located on the rear side of the under-head gap 427 in the cleaning direction, so that the cleaning liquid or the like adhering to the head lower surface 425 after the cleaning liquid ejecting part 612 has passed thereunder is removed.

In the inkjet printer 1, the upper surfaces 613*a* of the pair of positioning parts 613 are kept in contact with the block lower surface 426 even when the cleaning unit 61 is moving. Thus, the cleaning liquid ejecting part 612 moves along the head lower surface 425 while maintaining a constant distance from the head lower surface 425. The block lower surface 426 functions as a guideway that is used for moving the cleaning liquid ejecting part 612 along the head lower surface 425. The head fixation block 422 serves as a guiding part having the guideway.

In the head lower surface 425 shown in FIG. 12, a region where the outlets for ejecting ink are provided (hereinafter, referred to as an "outlet existence region") has a smaller width in the base material movement direction than the upper surface 612*a* of the cleaning liquid ejecting part 612. The outlet existence region is located above the upper surface 612*a* of the cleaning liquid ejecting part 612 across the entire width in the base material movement direction. Accordingly, the entire outlet existence region can be cleaned by moving the cleaning unit 61 in the cleaning direction while the cleaning liquid is held in the under-head gap 427 between the upper surface 612*a* of the cleaning liquid ejecting part 612 and the head lower surface 425.

Also, the wiping part 614 has a greater width in the base material movement direction than the upper surface 612*a* of the cleaning liquid ejecting part 612, and the opposite end portions of the wiping part 614 in the base material movement direction protrude beyond the opposite sides of the cleaning liquid ejecting part 612 in the base material movement direction. Thus, the wiping part 614 has a greater width in the base material movement direction than the aforementioned outlet existence region. Accordingly, it is possible, by moving the cleaning unit 61 in the cleaning direction, to wipe the entire outlet existence region with the wiping part 614 and to thereby remove the cleaning liquid or the like from the entire outlet existence region.

In each of the cleaning units 61, as described above, the pair of positioning parts 613 maintains a constant distance between the upper surface 612*a* of the cleaning liquid ejecting part 612 and the head lower surface 425 (i.e., the height of the under-head gap 427). It is thus possible to avoid a situation in which liquids such as the cleaning liquid held in the under-head gap 427 and the ink on the head lower surface 425 cleaned with the cleaning liquid spread from the under-head gap 427 to the surrounding area. This prevents liquids such as the cleaning liquid used to clean the head lower surface 425 from traveling along the side surface of the positioning parts 613 and reaching the upper surfaces 613*a*. As a result, a situation can be prevented in which the cleaning liquid or the like enters between the upper surfaces 613*a* of the positioning parts 613 and the block lower surface 426 of the head fixation block 422 via the positioning parts 613 and adheres to the block lower surface 426.

There are also cases in which the cleaning liquid or the like in the under-head gap 427 spreads to the surrounding area along with the movement of the cleaning unit 61 in the cleaning direction during the cleaning of the head lower surface 425. Even in this case, the cleaning unit 61, in which the cleaning liquid ejecting part 612 and the pair of positioning parts 613 are spaced from each other as described above, can prevent cleaning liquid or the like that has spread from the under-head gap 427 to the opposite sides in the base material movement direction from traveling along the side surfaces of the positioning parts 613 and reaching the upper surfaces 613*a* thereof. As a result, a situation can be prevented in which the cleaning liquid or the like enters between the upper surfaces 613*a* of the positioning parts 613 and the block lower surface 426 of the head fixation block 422 and adheres to the block lower surface 426.

As described above, the pair of positioning parts 613 are each in the shape of a wall extending in the X direction along the cleaning liquid ejecting part 612, and the space between the cleaning liquid ejecting part 612 and each of the pair of positioning parts 613 forms the groove-like first flow path 615 extending in the X direction. Thus, cleaning liquid or the like that has spread from the under-head gap 427 to the opposite sides in the base material movement direction will be guided in the X direction along the first flow paths 615 and flows down from the +X and −X sides of the upper surface 611*a* of the base part 611. This further prevents a situation in which cleaning liquid or the like that has spread from the cleaning liquid ejecting part 612 to the opposite sides in the base material movement direction enters between the upper surfaces 613*a* of the positioning parts 613 and the block lower surface 426 of the head fixation block 422 and adheres to the block lower surface 426.

In addition, the wiping part 614 is spaced from the end portions of the pair of positioning parts 613 on the rear side in the cleaning direction. Thus, the cleaning liquid or the like that has been guided in the +X direction through the first flow paths 615 will flow down to the base part 611 through the space between the wiping part 614 and each of the positioning parts 613 without being blocked by the wiping part 614. This further prevents a situation in which cleaning liquid or the like that has spread from the cleaning liquid ejecting part 612 to the opposite sides in the base material movement direction enters between the upper surfaces 613*a* of the positioning parts 613 and the block lower surface 426 of the head fixation block 422 and adheres to the block lower surface 426.

The cleaning liquid or the like flowing down from the base part 611 is received by the unit base 55 shown in FIG. 8. The inner bottom surface of the unit base 55 is an inclined surface that is inclined to the −Z side from the −X side to the +X side. Thus, the cleaning liquid or the like on the inner bottom surface of the unit base 55 flows to the +X side and is discharged to the outside by a discharging part provided at the +X-side lower end of the unit base 55.

As described above, the wiping part 614 is disposed at a distance from the cleaning liquid ejecting part 612 on the rear side of the cleaning liquid ejecting part 612 in the cleaning direction. This prevents cleaning liquid or the like that has spread from the under-head gap 427 to the rear side in the cleaning direction from moving upward along the −X side surface of the wiping part 614. The space between the cleaning liquid ejecting part 612 and the wiping part 614 forms the groove-like second flow path 616 extending in the base material movement direction. Accordingly, liquids such as cleaning liquid that has spread from the under-head gap 427 to the rear side in the cleaning direction and the cleaning liquid that has been wiped off the head lower surface 425 with the wiping part 614 are led to the opposite edge portions of the base part 611 in the base material movement direction through the second flow path 616 and are quickly removed from the base part 611. As a result, it is possible to prevent such cleaning liquid or the like from adhering to the head lower surface 425 and the block lower surface 426.

As shown in FIG. 12, in the inkjet printer 1, the upper surface 612*a* of the cleaning liquid ejecting part 612 has a smaller width in the base material movement direction than the head lower surface 425. In other words, the opposite edges of the upper surface 612*a* of the cleaning liquid ejecting part 612 in the base material movement direction are located between the opposite edges of the head lower surface 425 in the base material movement direction. Accordingly, cleaning liquid or the like that has spread from the under-head gap 427 to the opposite sides in the base material movement direction flows downward along the opposite side surfaces of the cleaning liquid ejecting part 612 in the base material movement direction before reaching the opposite edges of the head lower surface 425 in the base material movement direction. As a result, it is possible to prevent the cleaning liquid or the like from making its way to the opposite side surfaces of the ejection head 421 in the base material movement direction and adhering to these side surfaces.

The inkjet printer 1 is provided with the elevating mechanism 62 for moving the cleaning unit 61 up and down, as described above. Thus, when the cleaning unit 61 passes under the ejection head 421, the cleaning unit 61 can be moved upward and brought into contact with the ejection surface 44 of the head unit 4, and when the cleaning unit 61 moves between the ejection heads 421 arranged in the X direction, the cleaning unit 61 can be lowered so as to be spaced from the ejection surface 44. This prevents unnecessary friction with the positioning parts 613, the wiping part 614, and the ejection surface 44 (i.e., the head lower surface 425 and the block lower surface 426) and thereby makes it possible to increase the lifecycle of the cleaning unit 61.

In the inkjet printer 1, the cleaning liquid does not necessarily have to be supplied from the cleaning liquid ejecting part 612 to the under-head gap 427 during the cleaning of the head lower surface 425. For example, ink may be slowly pushed out of the outlets of the ejection head 421 facing the cleaning liquid ejecting part 612, filled in the under-head gap 427, and held by the cleaning liquid ejecting part 612. Then, as described above, the cleaning unit 61 may be moved forward in the cleaning direction so that the head lower surface 425 is cleaned with the ink held in the under-head gap 427. The ink adhering to the head lower surface 425 after the cleaning liquid ejecting part 612 has passed thereunder will be wiped off with the wiping part 614 and removed from the head lower surface 425.

In this case as well, it is possible to prevent ink that has spread from the under-head gap 427 to the surrounding area from adhering to the block lower surface 426 via the positioning parts 613, as with the case of cleaning with the cleaning liquid, because the cleaning liquid ejecting part 612 and the pair of positioning parts 613 are spaced from each other. In addition, since the space between the cleaning liquid ejecting part 612 and each of the pair of positioning parts 613 forms the groove-like first flow path 615 extending in the X direction, ink that has spread from the under-head gap 427 to the opposite sides in the base material movement direction will be guided in the X direction and quickly flow down from the base part 611. As a result, it is possible to further prevent ink from adhering to the block lower surface 426 via the positioning parts 613.

Moreover, the wiping part 614 is fixed to the base part 611 at a distance from the rear side of the pair of positioning parts 613 in the cleaning direction. Thus, ink that has been guided in the +X direction through the first flow path 615 will flow down from the base part 611 without being interrupted by the wiping part 614. Consequently, it is possible to further prevent ink from adhering to the block lower surface 426 via the positioning parts 613. Furthermore, the upper surface 612*a* of the cleaning liquid ejecting part 612 has a smaller width in the base material movement direction than the head lower surface 425. This prevents ink from making its way to the opposite side surfaces of the ejection head 421 in the base material movement direction and adhering to these side surfaces.

Note that if the inkjet printer 1 always uses ink ejected from the head unit 4 to clean the head lower surface 425 without using a cleaning liquid, the cleaning liquid ejecting part 612 may be replaced by a liquid holding part that has the same shape as the cleaning liquid ejecting part 612 but does not have the outlet 612*b*.

The inkjet printer described above can be modified in various ways.

In the inkjet printer 1 described above, when the mounting positions of the head unit 4 are changed, the positions of the cleaning units 61 and the elevating mechanisms 62 are also changed to positions that oppose the head assemblies 42 during maintenance. If the number of head assemblies 42 provided in the head unit 4 is changed, the number and positions of cleaning units 61 and elevating mechanisms 62 are also appropriately changed.

In each of the cleaning units 61, the shape of the pair of positioning parts 613 is not limited to the shape of a wall extending in the X direction (arrangement direction), and for example, each of the positioning parts 613 may be a plurality of projections that are disposed substantially parallel to the X direction on the upper surface 611*a* of the base part 611. That is, it is sufficient that each of the positioning parts 613 is in contact with the whole of a region extending parallel to the X direction on the block lower surface 426 of the head fixation block 422, or is in contact with a plurality of points that are spaced from one another in the X direction in that region.

The guide lower surface in contact with the positioning parts 613 is not limited to the block lower surface 426 of the head fixation block 422. For example, a pair of guide rails extending in the X direction may be fixed to the block lower surface 426 at a distance from the cleaning liquid ejecting part 612 on opposite sides of the cleaning liquid ejecting part 612 in the base material movement direction, and the lower surfaces of these guide rails may be used as guide lower surfaces. In this case, the head fixation block 422 and the pair of guide rails serve as a guiding part.

The inkjet printer 1 may also be configured such that the maintenance unit 51 is fixed at a predetermined position and the head unit 4 is moved in the X direction (the aforementioned arrangement direction) to clean the head lower surface 425. In other words, it is sufficient that the inkjet printer 1 is provided with a cleaning unit movement mechanism for moving the cleaning unit 61 and the head unit 4 relative to each other.

Depending on the design of the inkjet printer 1, a conveying mechanism for moving the head unit 4 in the movement direction may be provided. Specifically, it is sufficient that the base material 9 and the head unit 4 move relative to each other in the movement direction. Alternatively, the conveying mechanism may be a rotation mechanism in which the base material 9 is held on the outer circumferential surface of a substantially cylindrical drum and the drum is rotated at a position facing the head unit 4.

The inkjet printer 1 may use ink that is cured by irradiation of radiation (e.g., infrared rays or electron rays) other than UV rays. If the inkjet printer 1 uses ink that does not require irradiation of radiation, the curing part 35 may be omitted. The guideway 341 of the base material guiding part 34 does not necessarily have to be a curved surface, and it may be a flat surface.

The inkjet printer 1 may be configured to form an image on a sheet base material. For example, in an inkjet printer that holds a base material on a stage, the head unit moves relative to the base material in a scanning direction parallel to the stage (performs main scanning) while ejecting ink, then having reached the end of the base material, moves relative to the base material by a predetermined distance in a movement direction parallel to the stage and perpendicular to the scanning direction (performs sub-scanning), and thereafter moves relative to the base material in the opposite direction to the direction of the previous main scanning while ejecting ink. In this way, the inkjet printer described above (so-called "shuttle type printer") forms an image onto the base material by the head unit performing main scanning on the base material and intermittently performing sub-scanning in the width direction each time the main scanning has finished.

An object on which the inkjet printer 1 forms an image may be a base material 9 other than paper. For example, the inkjet printer 1 may form an image onto a plate-like or sheet-like base material 9 formed of plastic or the like.

The structures of the head unit 4 and the cleaning mechanism 60 described above may be applied to liquid ejection apparatuses other than inkjet printers (e.g., apparatuses for continuously ejecting and applying a material with fluidity, which includes an organic electroluminescent material, toward a base material such as a glass substrate). Also, a conveying mechanism for moving a base material may be provided independently of the liquid ejection apparatus.

The configurations of the embodiments and variations described above may be appropriately combined as long as there are no mutual inconsistencies.

While the invention has been shown and described in detail, the foregoing description is in all aspects illustrative and not restrictive. It is therefore to be understood that numerous modifications and variations can be devised without departing from the scope of the invention. This application claims priority benefit under 35 U.S.C. Section 119 of Japanese Patent Application No. 2013-049887 filed in the Japan Patent Office on Mar. 13, 2013, the entire disclosure of which is incorporated herein by reference.

REFERENCE SIGNS LIST

1 Inkjet printer
4 Head unit
9 Base material
44 Ejection surface
52 Unit movement mechanism
60 Cleaning mechanism
61 Cleaning unit
62 Elevating mechanism
421 Ejection head
422 Head fixation block
425 Head lower surface
426 Block lower surface
427 Under-head gap
611 Base part
612 Cleaning liquid ejecting part
613 Positioning part
614 Wiping part

The invention claimed is:

1. A liquid ejection apparatus comprising:

an ejecting part for ejecting a liquid toward a base material, said ejecting part and said base material moving relative to each other in a predetermined movement direction; and a cleaning mechanism for cleaning a lower surface of said ejecting part, said ejecting part including:

an ejection head having a head lower surface in which a plurality of outlets for ejecting the liquid are arranged in an arrangement direction that intersects said movement direction; and a guiding part for fixing a position of said ejection head relative to said guiding part and having a guide lower surface that is spaced from said head lower surface on each side in said movement direction, said cleaning mechanism including:

a cleaning unit to be brought into contact with said head lower surface; and a cleaning unit movement mechanism for moving said cleaning unit relative to said ejection head in a cleaning direction from one side to the other side in said arrangement direction to allow said cleaning unit to clean said head lower surface, and said cleaning unit including:

a base part;

a liquid holding part protruding above a central portion of said base part, said central portion facing said head lower surface, and for holding a liquid in a gap between said head lower surface and said liquid holding part;

a wiping part fixed to said base part further to a rear side of said cleaning unit in said cleaning direction than said liquid holding part and for wiping said head lower surface while in contact with said head lower surface; and a pair of positioning parts that are located on opposite sides of said liquid holding part in said movement direction, spaced from said liquid holding part, and protrude above said base part, and are for maintaining said gap while in contact with said guide lower surface, wherein said pair of positioning parts are each in the shape of a wall extending in said arrangement direction, a space between said liquid holding part and each of said pair of positioning parts is in the shape of a groove extending in said arrangement direction, and said groove forms a flow path on said base part for guiding said liquid to sides of said base part.

2. The liquid ejection apparatus according to claim 1, wherein said liquid holding part serves as a cleaning liquid ejecting part for supplying a cleaning liquid as said liquid into and holding said cleaning liquid in said gap between said head lower surface and said liquid holding part.

3. The liquid ejection apparatus according to claim 2, further comprising:

a unit base for receiving said liquid flowing down from said base part, said unit base having an inclined surface at an inner bottom of said unit base.

4. The liquid ejection apparatus according to claim 3, wherein said liquid holding part has a smaller width in said movement direction than said head lower surface.

5. The liquid ejection apparatus according to claim 4, wherein said wiping part is fixed to said base part at a distance from rear ends of said pair of positioning parts in said cleaning direction.

6. The liquid ejection apparatus according to claim 5, wherein said cleaning mechanism further includes an elevating mechanism for moving said cleaning unit up and down.

7. The liquid ejection apparatus according to claim 6, wherein said ejecting part ejects fine droplets of ink.

8. The liquid ejection apparatus according to claim 1, wherein further comprising:

a unit base for receiving said liquid flowing down from said base part, said unit base having an inclined surface at an inner bottom of said unit base.

9. The liquid ejection apparatus according to claim 8, wherein said liquid holding part has a smaller width in said movement direction than said head lower surface.

10. The liquid ejection apparatus according to claim 9, wherein said wiping part is fixed to said base part at a distance from rear ends of said pair of positioning parts in said cleaning direction.

11. The liquid ejection apparatus according to claim 10, wherein said cleaning mechanism further includes an elevating mechanism for moving said cleaning unit up and down.

12. The liquid ejection apparatus according to claim 11, wherein said ejecting part ejects fine droplets of ink.

13. The liquid ejection apparatus according to claim 1, wherein said liquid holding part has a smaller width in said movement direction than said head lower surface.

14. The liquid ejection apparatus according to claim 13, wherein said wiping part is fixed to said base part at a distance from rear ends of said pair of positioning parts in said cleaning direction.

15. The liquid ejection apparatus according to claim 14, wherein said cleaning mechanism further includes an elevating mechanism for moving said cleaning unit up and down.

16. The liquid ejection apparatus according to claim 15, wherein said ejecting part ejects fine droplets of ink.

17. The liquid ejection apparatus according to claim 1, wherein said wiping part is fixed to said base part at a distance from rear ends of said pair of positioning parts in said cleaning direction.

18. The liquid ejection apparatus according to claim 17, wherein said cleaning mechanism further includes an elevating mechanism for moving said cleaning unit up and down.

19. The liquid ejection apparatus according to claim 1, wherein said cleaning mechanism further includes an elevating mechanism for moving said cleaning unit up and down.

20. The liquid ejection apparatus according to claim 1, wherein said ejecting part ejects fine droplets of ink.

* * * * *